United States Patent [19]

Bagheri

[11] Patent Number: 4,706,539

[45] Date of Patent: Nov. 17, 1987

[54] SANTUR

[76] Inventor: Parichehr Bagheri, 936 N. San Vicente, Unit #12, Los Angeles, Calif. 90069

[21] Appl. No.: 851,536

[22] Filed: Apr. 14, 1986

[51] Int. Cl.[4] ..... G10D 1/12

[52] U.S. Cl. ..... 84/284; 83/173

[58] Field of Search ..... 84/173, 284–289

[56] References Cited

U.S. PATENT DOCUMENTS

| | | | |
|---|---|---|---|
| 479,323 | 7/1892 | Bagdasarian | 84/284 |
| 625,663 | 5/1899 | Everton et al. | 84/284 |
| 853,536 | 5/1907 | Doughton | 84/285 X |
| 1,253,550 | 1/1918 | Wilkins | 84/285 |

FOREIGN PATENT DOCUMENTS

| | | | |
|---|---|---|---|
| 218102 | 11/1941 | Switzerland | 84/285 |

OTHER PUBLICATIONS

S. Sadie, The New Grove Dictionary of Musical Instruments, 1984, pp. 291–292.

*Primary Examiner*—Lawrence R. Franklin

*Attorney, Agent, or Firm*—Lyon & Lyon

[57] ABSTRACT

A santur which having two continuous, two-story bridges extending along the length of either side wall of the santur, two continuous, two-story clicks extending along the side walls of the santur and levers and clicks for simple, fast tuning of the santur and for enabling the santur to play half and quarter notes.

4 Claims, 10 Drawing Figures

SANTUR

The present invention relates to an improved santur, which has an increased range of notes available for playing and has a new type of bridge, lever and click arrangement for easy tuning.

The santur is a stringed instrument dating from approximately the 15th century. A description of the conventional or traditional santur many be found in the New Grove Dictionary of Musical Instruments by Stanley Sadie, 1984, at pages 291–292, from which the following information was taken. "The traditional santur is well known in certain areas of the world and is an important instrument in Iran and other Middle Eastern, Southwestern European and South Asian countries. The santur consists of a trapeziform case made of walnut wood, approximately 90 cm wide at the broad end, 35 cm wide at the narrow end and 6 cm deep. The sides form an angle of 45° to the wider end. The strings are fixed to hitch-pins along [one] side and wound round metal wrest-pins on the [other side] by means of which they are tuned with a tuning-key. Each quadruple set of strings rests on a movable bridge of hardwood (kharak). These bridges are aligned almost parallel with the sides of the case. The right-hand rank corresponds to the *bass* strings and that on the left to the *treble* strings. In the centre of the santur the low-pitched strings on the right cross the high-pitched strings on the left.

The left-hand strings can be played on either side of the bridges. In this way three different courses of strings are available: the lowest-sounding on the right, a second series, sounding an octave higher, left of centre, and the highest-sounding series, giving the third octave, on the left. There are nine (or sometimes 11) quadruple strings on either side so that, with 18 groups of strings, 27 different notes can be played. The bass strings are of bass and the trebles of steel. The first series of strings has a range of e′–f′, the second e″–f″ and the third e‴–f⁗, just over three octaves. The tuning can be readily modified by adjusting the position of the bridges.

The santur is played by striking the strings with two hammers (mezrab) held in three fingers of each hand. The hammers of the Turkish and Indian instruments are heavy and bounce on the string, creating a characteristic automatic tremolo. The very light Persian hammers do not rebound and the tremolo is controlled solely by a rapid alternating movement of the right and left wrists. Tradition calls for a delicate and precise tone-quality which is obtained only with light hammers of hardwood. Some players wrap the ends of the hammers with felt to soften the impact. The same result can be obtained by laying a piece of cloth on the strings, as was sometimes done by older performers.

"The contemporary Iraqi santur consists of a soundbox in the shape of a trapezium made from two boards of wood joined together by splints of varying height; the soundbox is made from a hardwood such as walnut, bitter orange, white beech or apricot. It is approximately 80 to 90 cm wide at the broad end, 31 to 41 cm wide at the narrow end and 7 to 12 cm deep, though the instrument has often been made to accompany a specific singer, so the dimensions of the soundbox are changed to accommodate the register of the singer's voice."

One problem with the conventional or traditional santur is that it is not capable of playing half and quarter notes. Also, the conventional santur requires a long time for tuning because each of the kharaks must be individually adjusted. For these reasons, it has been heretofore impossible for the santur to be played in an orchestra.

An object to the present invention is to provide a santur which may be turned with one-time tuning which can play all Eastern and Western music. It is a further object of this invention to provide a santur which has 156 different notes, including half and quarter notes. It is still a further object of this invention to provide a santur which can be tuned, with novel levers provided, while playing. The lever enables the player to change the notes from a sharp to a flat, and from a half to a quarter note.

The improved santur of the present invention is directed to a santur having a two-story bridge construction rather than a plurality of bridges as found in the conventional santur. The improved santur of the present invention also embodies extended clicks having a plurality of spaces beneath an upper portion.

The present invention will be described in the following specification in connection with the preferred embodiment thereof and with reference to the accompanying drawings, wherein:

FIG. 3 is a plan view of the improved santur of the present invention.

Figure 1:
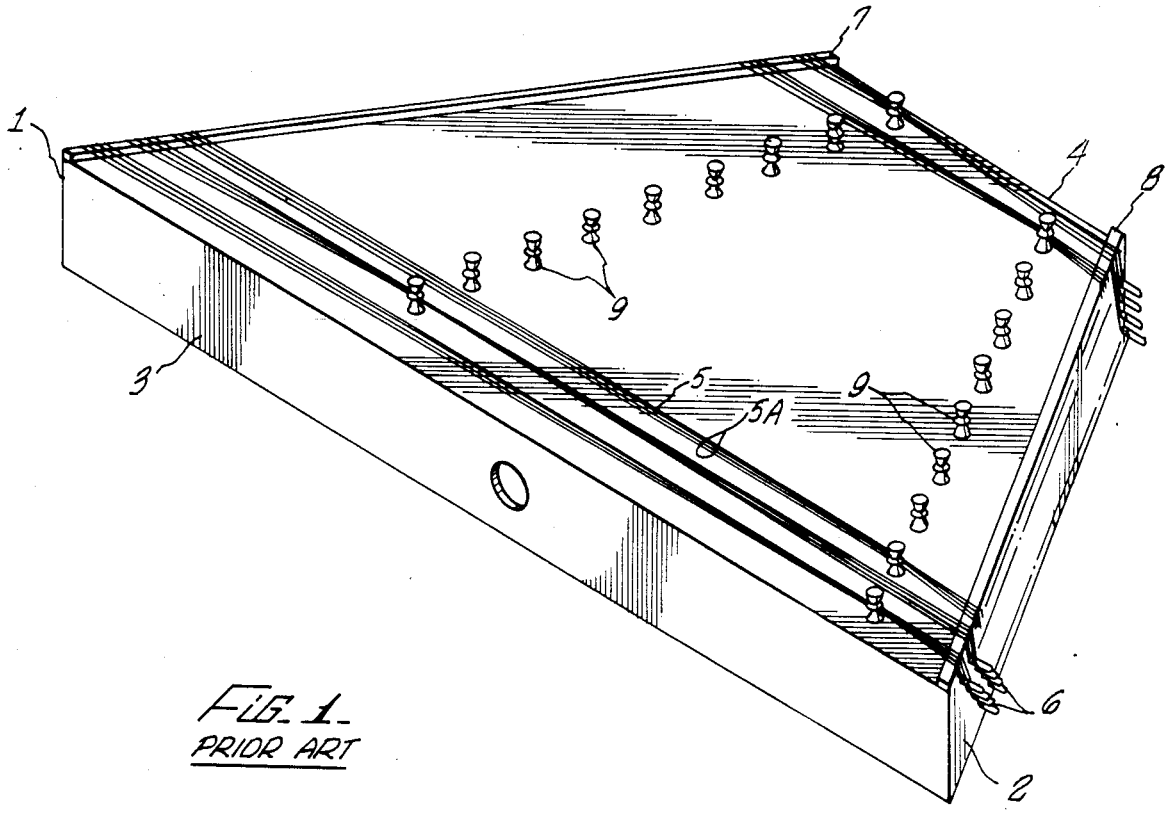
FIG. 1 PRIOR ART
FIG. 1 is a perspective view of the traditional Prior Art Santur.

Referring first to FIG. 1 which shows the conventional santur, it may be noticed that the santur case has left wall 1, right wall 2, front side 3 and back side 4. The sides 1 and 2 form a 45° angle at the wider end with the front side 3, as is shown at the juncture of side wall 1 with front wall 3. Strings 5 are stretched across the santur from the left side 1 to the right side 2 in groups of four (quadruple) shown at 5A. Each string 5 is attached to a hitch-pin on the left side 1 (not shown) and to a wound round metal wrest-pin 6 on right side 2. Typically, there are nine, and sometimes eleven quadruples of strings on either side so that with 18 groups of strings 3 octaves or 27 different notes can be played. Each quadruple set of strings may be played in three octaves. Each quadruple set of strings rests on a movable hardwood bridge 9, also known as a kharak, which is aligned almost parallel with side 1 and side 2 respectively. The right hand rank of kharaks correspond to the bass strings and the left-hand rank of kharak correspond to the treble strings. The low-pitched bass strings and the high-pitched treble strings cross in the center. As shown in FIG. 1, there are nine kharaks in the right rank and nine in the left rank. Left side click 7 and right side click 8 are positioned on the side walls of the santur. As shown in FIG. 1 the click means are solid bar-like structures located at the sides of the santur and function to support the strings as they change direction at the edge of the santur.

Figure 2:
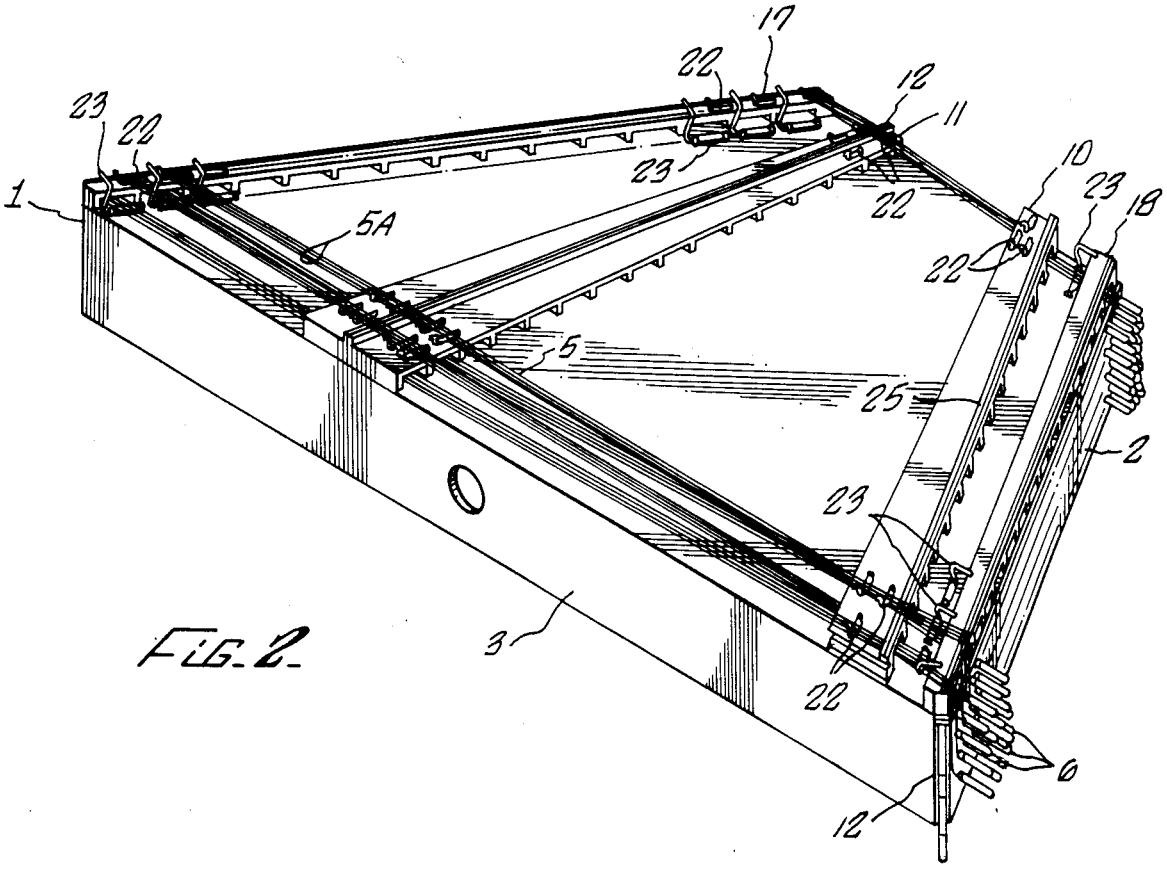
FIG. 2 is a perspective view of the improved santur of the present invention.
Figure 4:
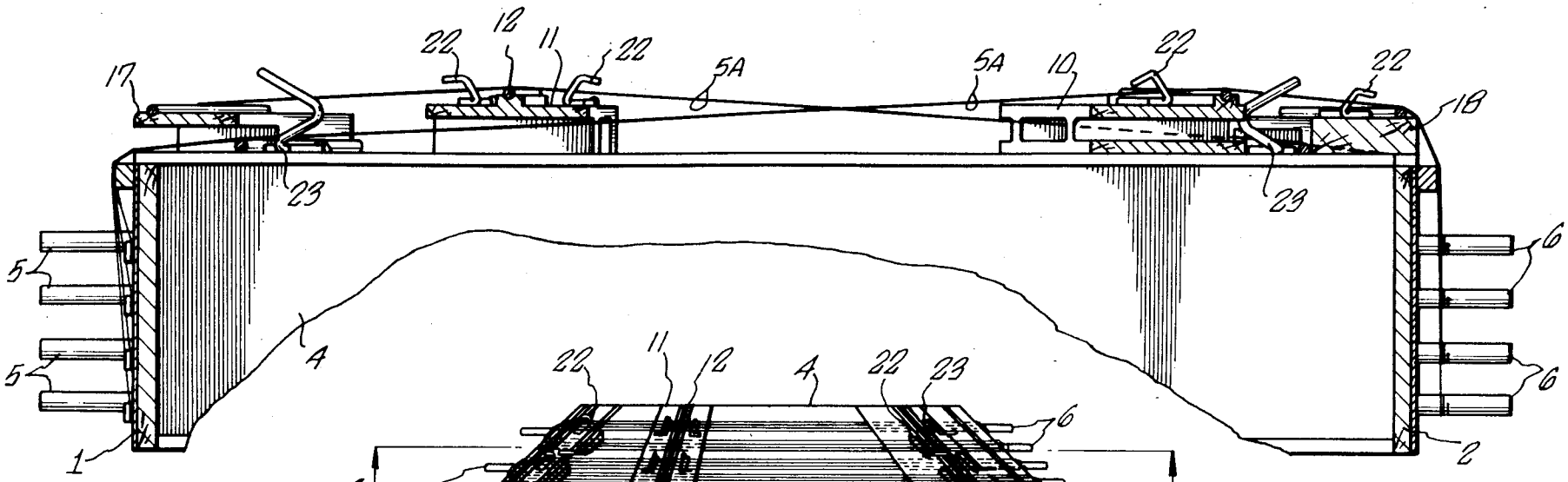
FIG. 4 is a cross-sectional view of the improved santur taken along line 4—4 of FIG. 3.

Referring to FIG. 2, the preferred embodiment of the present invention is shown with corresponding numbers showing corresponding parts of the conventional santur compared to the santur of the present invention. Two novel features readily apparent from FIG. 2 are the continuous, two-story bridges 10 and 11 which replace the conventional kharaks. Continuous two-story bridge 10 is positioned on the right side and is also known as the bass bridge 10. Continuous two-story bridge 11 is positioned on the left and is also known as the treble bridge 11. Treble bridge 11 has a thick wire ridge 12 running on its surface along its centerline for separating the octaves on the left from the octaves on the right so that the lower notes are played on the right and the higher notes are played on the left of the wire ridge 12 of bridge 11. Bass bridge 10 has a wire ridge 25 on its upper right surface, as shown in FIG. 2. Bridges 10 and 11 are positioned almost parallel to the side walls 1 and 2 of the santur. Bass bridge 10 carries all of the bass strings and treble bridge 11 carries all of the treble strings. This is in contrast to the conventional santur, which has a separate bridge or kharak for each quadruple set of strings. The arrangement of the crossing of the strings and their location with respect to the bridges, clicks and levers may be seen in FIG. 4. Levers 22 and 23 are positioned on the santur as indicated. Novel clicks 17 and 18 are located on the left and right sides of the santur. As shown in FIGS. 2 and 4 the click means are bridge-like structures located at the sides of the santur and have openings for permitting sets of quadruple strings to pass through. The clicks 7 and 18 have levers 22 positioned on their upper surface for adjusting the tension of the strings. Also, the improved santur may be constructed with metal braces 12 at the front left and right edges for stability without adverse effect on the sound produced.

Figure 5:
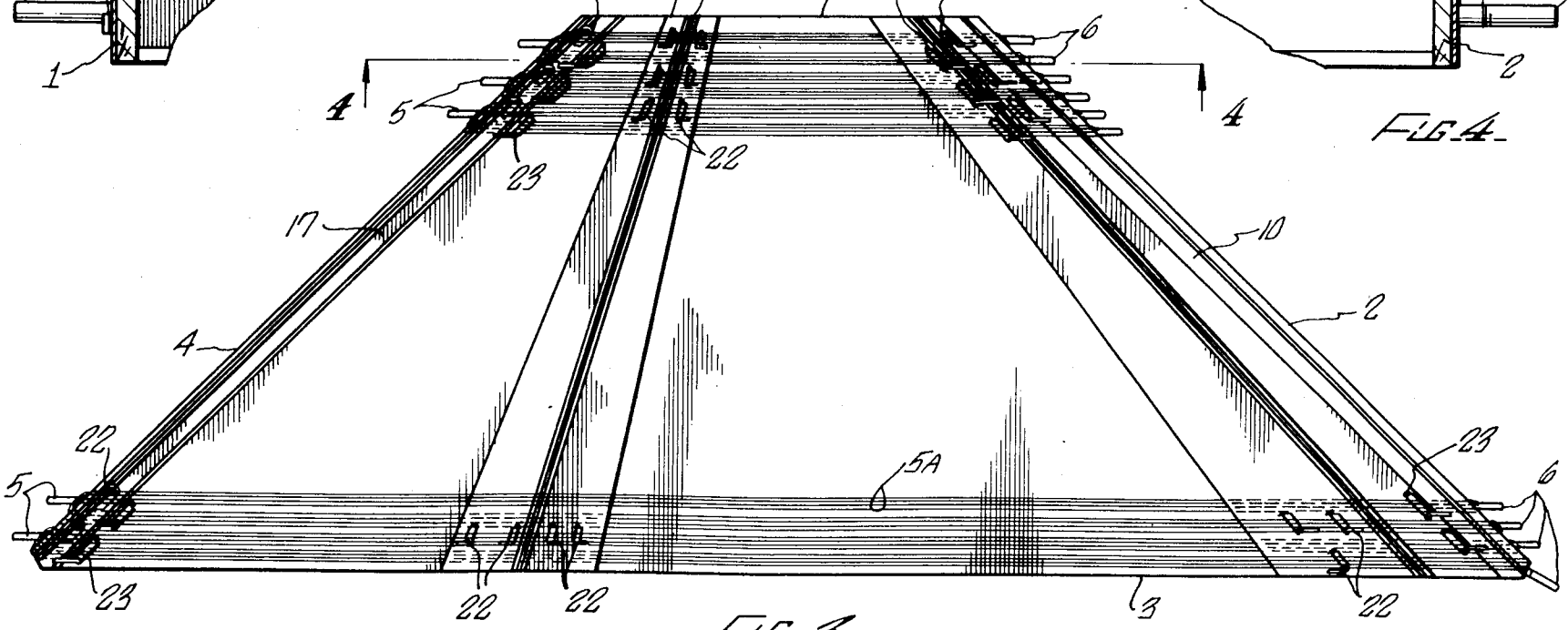
FIG. 5 is an elevational view of the two story bridge of the improved santur.
Figure 5:
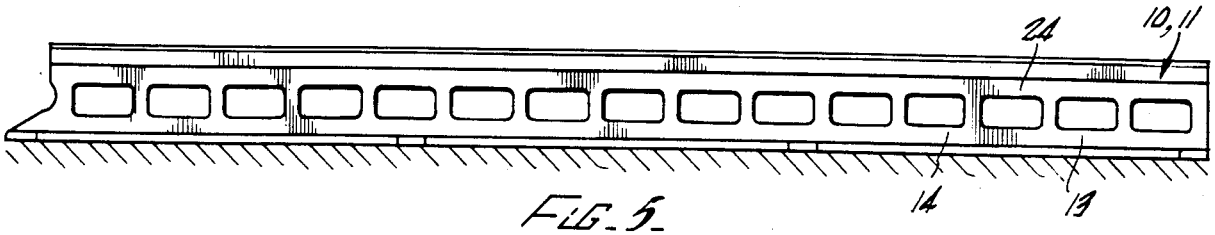

Referring to FIG. 3, it is readily apparent that all of the bass, or treble strings, respectively, may be carried by each of the bass, and treble bridges, respectively as will be described. On treble bridge 11 the treble strings rest on wire 12 and on levers 22. On bass bridge 10 the strings rest on wire 25 and on levers 22. Also, as may be seen from FIG. 5, bridges 10 and 11 may be arranged in a two-story construction with an upper member 24, a lower member 13 and plurality of vertically extending members 14. The members 24, 13 and 14 are arranged to create a space therebetween for the passage of quadruples of strings therethrough. It is also possible to construct the bridges without the lower member 13 as shown for example by bridge 11 in FIG. 2. Thus, each quadruple of bass strings would be passed through one of the spaces defined by the members 24, 13 and 14 on the treble bridge 11 and each quadruple of treble strings would pass through the space formed by members 24, 14 and the surface of the santur of the bass bridge 10.

Figure 6:
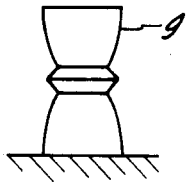
FIG. 6 PRIOR ART
FIG. 6 is an elevational view of a bridge of the Prior Art santur.

In FIG. 6, a side view of a bridge 9 or kharak of the conventional santur is shown. As may readily be seen, there is no provision for a two-story construction as in the present invention and as seen from FIGS. 1 and 6 there is no provision for a unitary construction or a bridge construction such that a single bridge runs the entire length of either side wall of the conventional santur.

Figure 7:
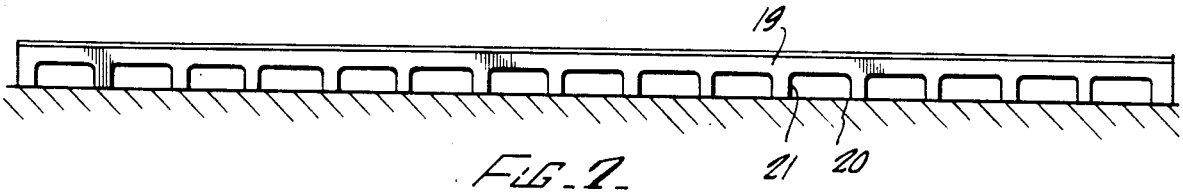
FIG. 7 is an elevational view of the click of the present invention.
Figure 8:
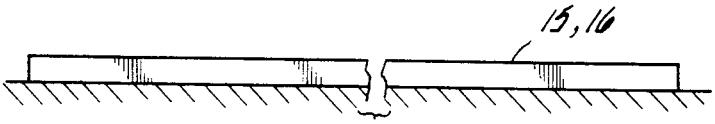
FIG. 8 PRIOR ART
FIG. 8 is an elevational view of the click of the Prior Art santur.

As more readily seen in FIGS. 7 and 8, the differences between the conventional click and the click of the present invention are readily apparent. FIG. 7 is a view of the click of the present invention, having an upper member 19, and vertically arranged members 21. Along the lower portions of members 21 is positioned a wire 20 which extends the length of each click. FIG. 8 shows a conventional click. The clicks of both the conventional and present santur are continuous, unitary pieces extending along the length of the side walls of the santur and upon which the strings 5 rest as they make a ninety degree bend down along the sides 1 and 2 for fastening to pins 6. As may be seen in FIG. 7, the two-story construction of the click of the present invention provides a space between which the quadruple sets of strings may pass. As may be seen in FIG. 8, showing the conventional click, no such spaces are provided.

Figure 9:
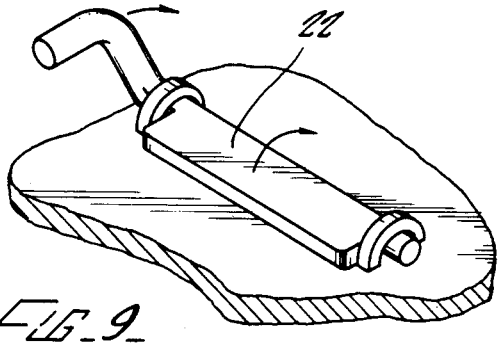
FIG. 9 is a perspective view of the lever located on the two story bridge and on the new left side click of the present invention.
Figure 10:
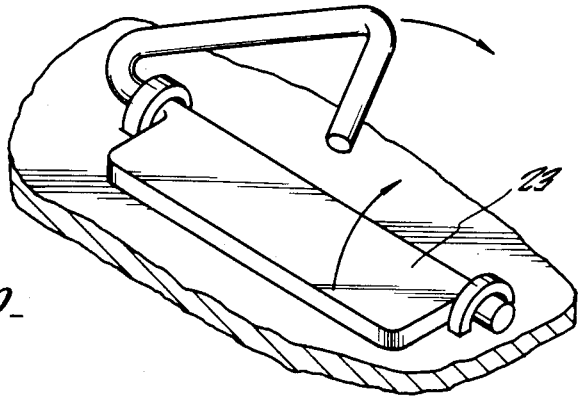
FIG. 10 is a perspective view of a lever located on the surface of the improved santur of the present invention.

In FIG. 9 an enlarged view of one of a plurality of levers 22 is shown. Levers 22 are located on the bridges 10 and 11 and on left click 17 as shown in FIG. 2. FIG. 10 shows levers 23 which are located on the surface of the santur as shown in FIGS. 2 and 3. In a preferred embodiment there are fifteen levers 23 on the left side near click 17 and fifteen lever 23 on the right side near click 18.

With the preferred embodiment thus described, it may be readily seen, that after tuning, all 156 notes of the parted octaves of Western music and the 24 parted octaves Eastern or Iranian music may be played in a simple, single operation. As is also apparent, these octaves can play major and minor notes of Western and Eastern music and it is now possible for the santur to be played in any Western or Eastern orchestra.

With the improved santur there can be played five different sounds for almost every quadruple set of strings. This is in comparison to the conventional santur in which only one sound can be played for each quadruple.

The claimed invention is:

1. A santur comprising two side walls, a front wall, a back wall, the side walls joined at a 45° angle with the front wall, a plurality of strings extending across the santur from one side wall to the other and being arranged into a plurality of groups of four strings per group and being attached to the side walls with hitch-pins and wrest-pins on the side walls of the santur, the improvement comprising bridge means wherein the length of the bridge means is substantially equal to the length of the side walls of the santur and wherein each bridge means is arranged to carry a plurality of groups of four strings, and left and right click means for supporting the strings located on each side wall of the santur wherein each click means is arranged to carry a first plurality of the groups of four strings and to permit passage thereunder of a second plurality of the groups of four strings, and first lever means for adjusting tension of the strings located on the bridge means and left click means, and second lever means for adjusting tension of the strings located on the surface of the santur near each left and right click means.

2. The santur of claim 1 wherein the bridge means is of a unitary construction having an upper portion member substantially the length of the santur, a lower member extending substantially along the length of the santur, and a plurality of vertical members extending between the upper member and lower member to form a plurality of spaces for passage of said plurality of groups of four strings.

3. The santur of claim 1 wherein the click means comprises a unitary construction extending along the the santur and having an upper member, a lower member a plurality of vertical portions therebetween for forming a plurality of spaces through which a plurality of said four strings may be passed.

4. A musical instrument comprising front and back walls, two side walls having a plurality of strings extending from one of the side walls to the other and arranged into groups of bass strings and groups of treble strings wherein the strings are fastened to the side walls, bass bridge means and treble bridge means for supporting the strings located intermediate and generally parallel to the side walls wherein the treble strings are supported by a ridge on the treble bridge, the bass strings are supported by a ridge on the bass bridge, the treble strings pass under the bass bridge ridge and the bass strings pass under the treble bridge ridge, and further comprising two click means having an upper surface and a plurality of spaces therein and wherein one click means supports the treble strings on its upper surface and permits passage of the bass strings through its passages and wherein the other click means supports the bass strings on its upper surface and permits passage of the treble strings through its passages.

* * * * *